US005193355A

United States Patent [19]

Matsumi

[11] Patent Number: 5,193,355

[45] Date of Patent: Mar. 16, 1993

[54] INTEGRATED TYPE AIR CONDITIONER

[75] Inventor: Hideki Matsumi, Shiga, Japan

[73] Assignee: Matsushita Electric Industrial Co., Ltd., Osaka, Japan

[21] Appl. No.: 689,747

[22] PCT Filed: Sep. 25, 1990

[86] PCT No.: PCT/JP90/01229

§ 371 Date: May 20, 1991

§ 102(e) Date: May 20, 1991

[30] Foreign Application Priority Data

Sep. 26, 1989 [JP] Japan ..... 1-249556

[51] Int. Cl.[5] ..... F25D 23/12

[52] U.S. Cl. ..... 62/262; 312/101; 454/201

[58] Field of Search ..... 62/262, 263; 312/101; 417/350, 423.15, 360; 454/201

[56] References Cited

U.S. PATENT DOCUMENTS

| | | | |
|---|---|---|---|
| 2,682,159 | 6/1954 | Trask | 62/262 |
| 2,984,089 | 5/1961 | Whitesel | 62/262 |
| 3,727,421 | 4/1973 | Berg | 62/262 |
| 3,906,741 | 9/1975 | Terry | 62/262 |
| 4,633,680 | 1/1987 | Lang et al. | 62/262 |

FOREIGN PATENT DOCUMENTS 57-47634 10/1982 Japan .

*Primary Examiner*—John Sollecito

*Attorney, Agent, or Firm*—Stevens, Davis, Miller & Mosher

[57] ABSTRACT

A structure is provided in which fundamental component parts including a base plate and an outer casing are integrally formed of resin moldings 2 and 3 on the indoor side and the outdoor side, and a bulk head 4 formed of a sheet metal is provided as a partition between the indoor side and the outdoor side, so that the number of fundamental parts is small and that an improvement in quality can be achieved.

7 Claims, 16 Drawing Sheets

INTEGRATED TYPE AIR CONDITIONER

DESCRIPTION

1. Technical Field

This invention relates to the construction of an integrated type air conditioner mounted in a sash window or vertical sash, and an assembly method and an attachment device for this air conditioner 2. Background Art In United States of America and other countries, sash windows are widely used as house windows, and air conditioners of a type to be fitted in a sash window are popularly used.

Such a conventional air conditioner will be described below with reference to the drawings.

First, a description will be made with reference to FIGS. 1 to 5. A main body 101 of an integrated type air conditioner is composed of a front grill 102, an outer casing 103, and an internal unit 104 fitted in the outer casing and capable of being drawn out therefrom. The outer casing 103 is a sheet metal component part which has louvers 105 formed in its top and side surfaces by being cut and raised, to which a wire mesh 106 is welded at its rear side, to which connectors 107 and 108 serving as reinforcements are welded at the front and rear sides of its bottom, which is painted for rust prevention, and to which heat insulating members and sealing members are attached for heat insulation and prevention of air leaks. The internal unit 104 is constituted by a base plate 109 formed of a sheet metal member, and a bulk head 112 which separates an outdoor air circuit 110 and an indoor air circuit 111 provided on the base plate 109. For the outdoor air circuit 110, there are provided a condenser 113, a propeller fan 114, a motor 115, a motor base 116, an air guider 117, a connection frame member 118 for reinforcement of the air guider 117 and the bulk head 112, a condenser 119 for forming a refrigerating cycle which is known per se, and a condenser cover 120. The condenser 113 has its two ends screwed to two ends of the air guider 117 and is thereby fixed on the base plate 109. The indoor air circuit 111 is composed of an evaporator 121, water receiving tray 122, a scirocco fan 123, a scirocco air guider 124, a scirocco air guider side plate 125, a duct 126 and a top cover 127 for protecting the duct 126 while maintaining the strength of the bulk head 112. A description will now be given of air flows. On the indoor side, indoor air is drawn thereinto through an intake section 128 of the front grill 102 by the scirocco fan 123, cooled by the evaporator 121, supplied through the scirocco air guider 124 and the duct 126, and blown out to the indoor side through a blowing grill 129. On the outdoor side, outdoor air is drawn in through an intake opening 130 formed in the rear surface of the outer casing 103, heated up by the condenser 113, supplied through the air guider 117, and blown out to the outdoor side through the louvers 105. Next, a description will be given of installation. First, an L-shaped plate 128 which overlaps a sash frame is fixed on the top surface of the outer casing 103 with screws. Then a generally U-like plate 129 is fixed on the bottom surface of the outer casing 103 with screws. Next, mount members (not shown) are fitted in the L-shaped plate 128 and the U-like plate 129, and the main body 101 is set in the window.

In this conventional arrangement, however, all the fundamental structure parts are sheet metal, and the number of necessary component parts is large. The possibility of occurrence of quality dispersion depending upon the dimensional accuracy of respective parts and the assembly accuracy is high, and an improvement in quality is therefore required. Since the majority of necessary component parts are made of sheet metal, the amounts of materials for rust prevention treatment, heat insulation and so on are large, and there is therefore a need for a reduction in the number of component parts.

Since the condenser 113 is fixed with screws to the air guider 117 whose size is determined by the base plate 109, the bulk head 112, the connectors 107 and 108 and other members, its mounting dimensions are changed if the accuracy of the size of any one of these component parts is changed. Thus, the possibility of occurrence of a quality dispersion is high, and an improvement in quality is required.

The main body cannot be installed without L-shaped plate 128 and U-like plate 129, and all these mount parts are attached with the use of screws by the installer. Therefore the possibility of occurrence of dispersion of the installed condition is high, and accordingly stabilization of the installed condition and simplification of installation are required. For assembly of the main body, parts and screws must be attached in several directions, the operational facility is therefore low, and automatic assembly cannot be performed. Thus, labor saving using automatic assembly or the like is required.

DISCLOSURE OF THE INVENTION

According to the present invention, therefore, a base plate and an outer casing are integrally formed as resin moldings on the indoor side and the outdoor side, and a bulk head formed of sheet metal is provided at the boundary between the indoor side and the outdoor side, the bulk head engaging at its upper and lower sides with the integrally formed molding on the outdoor side, the integrally formed molding on the indoor side being engaged with the bulk head.

Further, according to the present invention, a base plate and an outer casing are integrally formed as resin moldings on the indoor side and the outdoor side, a lower portion of the integrally formed molding on the outdoor side is extended to the indoor side, and a bulk head formed of a sheet metal is provided at the boundary between the indoor side and the outdoor side, the bulk head engaging at its upper and lower sides with the integrally formed molding on the outdoor side, the integrally formed molding on the indoor side engaging with the bulk head.

Further, according to the present invention, a base plate and an outer casing are integrally formed as resin moldings on the indoor side and the outdoor side, screw bosses are provided on the rear side of the integrally formed part on the outdoor side generally at the center thereof and at the positions where the two side end plates of the condenser are located, and screw attachment holes are formed in the two side end plates of the condenser.

Further, according to the present invention, a base plate and an outer casing are integrally formed as resin moldings on the indoor side and the outdoor side, a bulk head formed of a sheet metal and having an upper end protruding beyond the integrally formed molding on the outdoor side is provided at the boundary between the indoor side and the outdoor side.

Further, according to the present invention, a base plate and an outer casing are integrally formed as resin moldings on the indoor side and the outdoor side, ribs which define grooves into which a mount device is inserted are provided on the top and bottom surfaces of the integrally formed molding on the outdoor side, and these ribs are brought into contact with window members at the time of installation, thereby enabling the main body to be installed in the desired condition.

Further, according to the present invention, all the parts and screws can be attached and fastened from the indoor side.

The fundamental component parts are formed of resins, and the number of parts is reduced, so that the part precision and assembly precision are improved and that the quality is stabilized. The base plate portion on the outdoor side formed as a resin member is extended to the indoor side, so that condensate produced on the indoor side is collected on the resin base plate. There is therefore no need for a rust prevention treatment and a heat insulating material.

The condenser is directly fixed to the rear side of the integrally formed molding on the outdoor side formed as a resin member. The assembly dimensional accuracy can therefore be improved.

The bulk head also serves as a mount device. Therefore the number of parts is reduced, the installation accuracy can be improved and the installation can be simplified.

The main body can be installed with accuracy in the desired condition by means of ribs of the molding on the outdoor side.

Because the main body parts and screws are mounted from the indoor side alone, assembly automation, labor saving and an improvement in quality can be achieved.

BEST MODE FOR CARRYING OUT THE INVENTION

Figure 1:
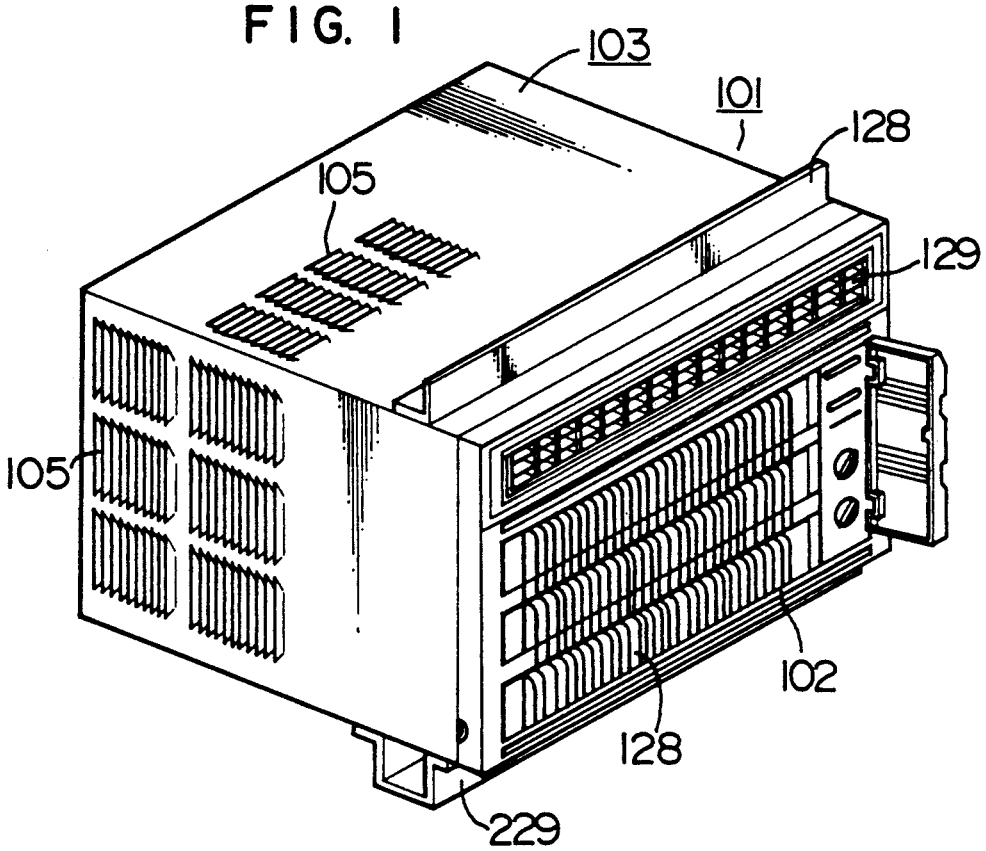
PRIOR ART FIG. 1
FIG. 1 is a front perspective view of a conventional integrated type air conditioner.
Figure 2:
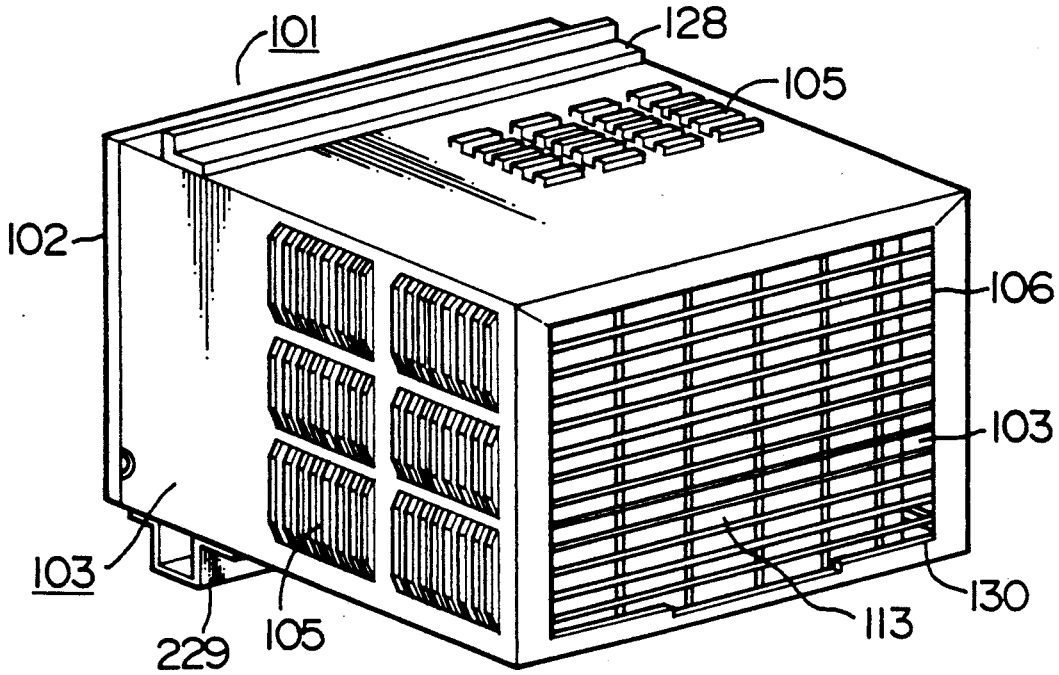
PRIOR ART FIG. 2
FIG. 2 is a rear perspective view of the identical integrated type air conditioner.
Figure 3:
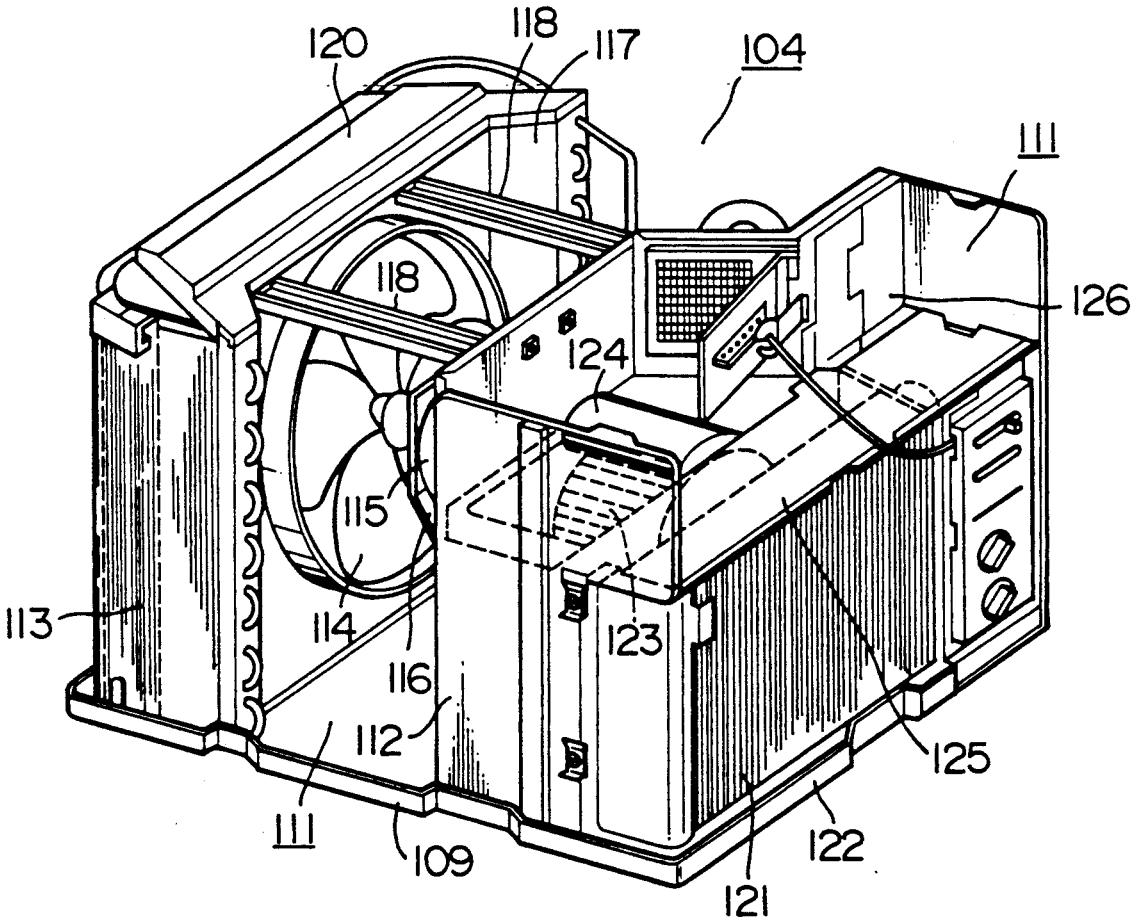
PRIOR ART FIG. 3
FIGS. 3 and 4 are perspective views showing the interior of the identical integrated type air conditioner.
Figure 4:
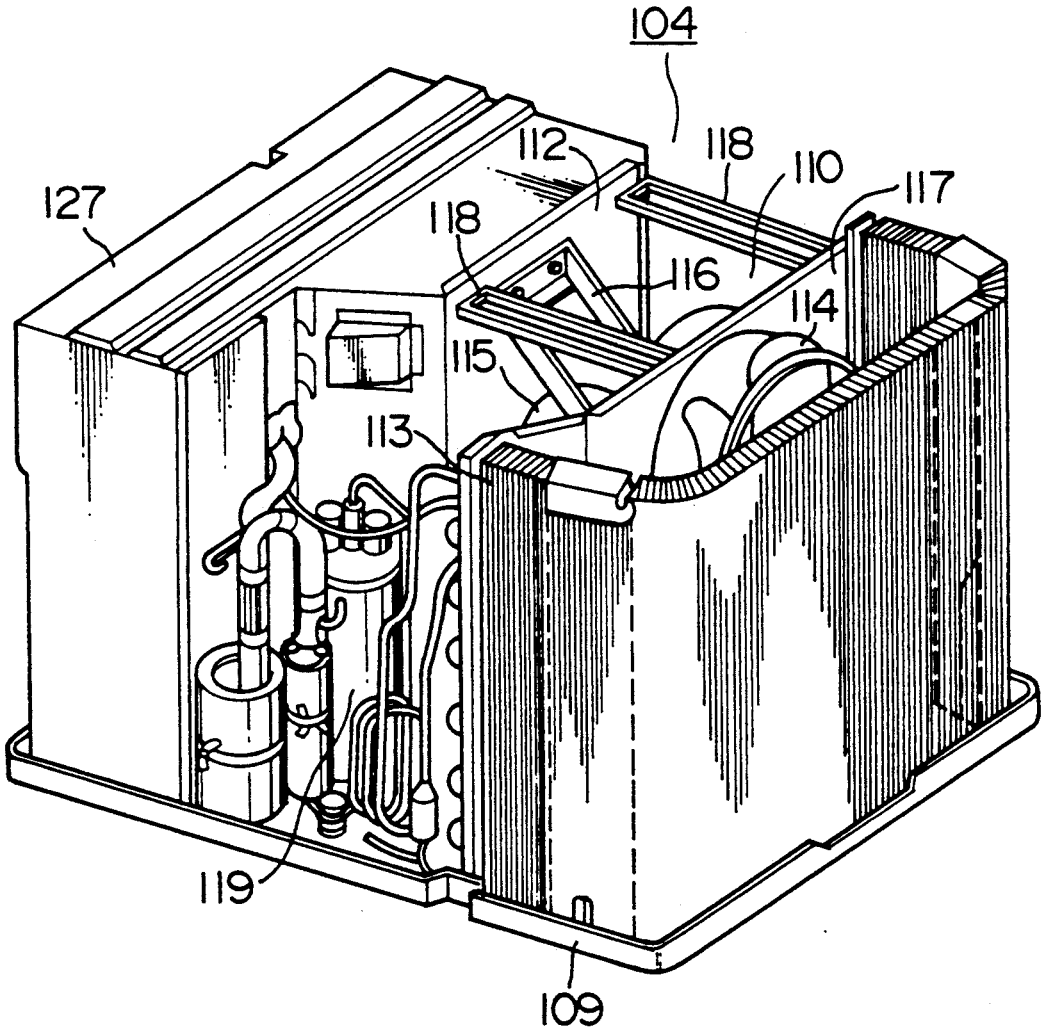
PRIOR ART FIG. 4
Figure 5:
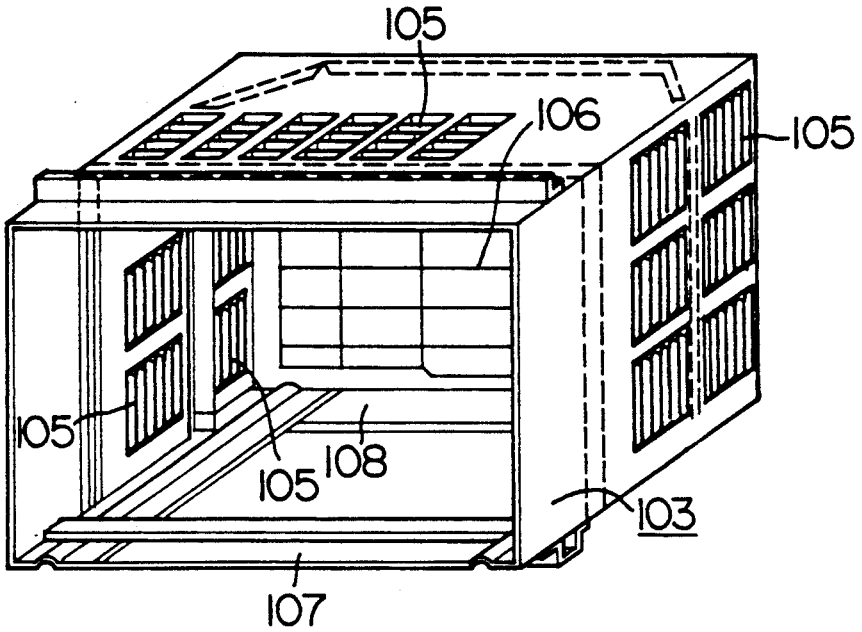
PRIOR ART FIG. 5
FIG. 5 is a perspective view of an outer casing of the identical integrated type air conditioner.
Figure 6:
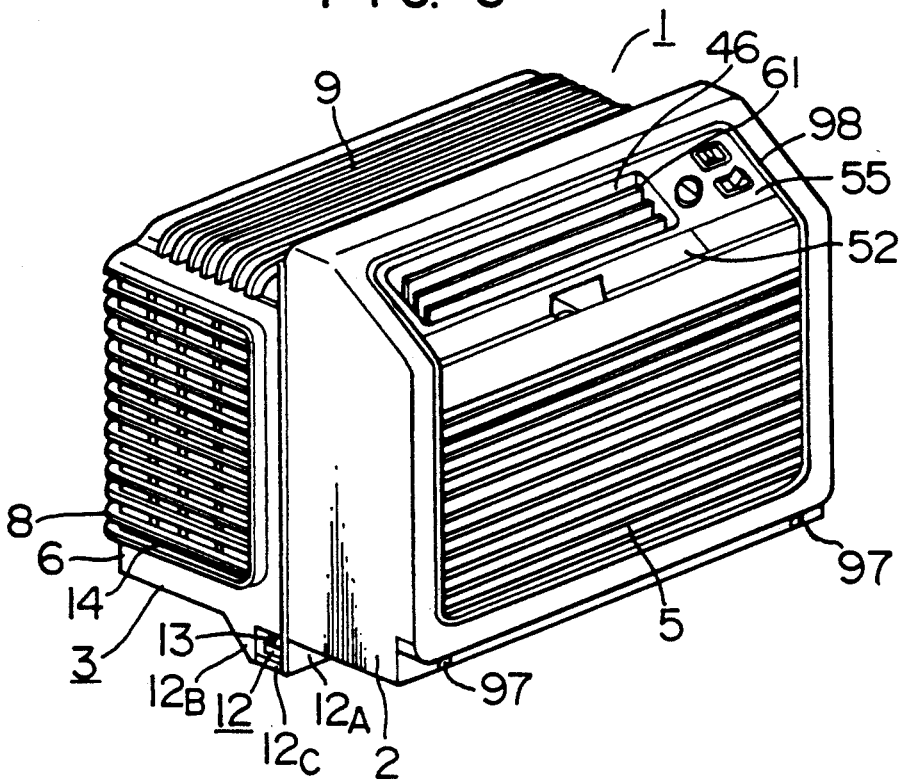
FIG. 6 is a front perspective view of an integrated type air conditioner in accordance with an embodiment of the present invention.

An embodiment of the present invention will be described below with reference to the accompanying drawings. The overall structure of an integrated type air conditioner will be described first. Referring to FIGS. 6 to 24, a main body 1 of the integrated type air conditioner is composed of an indoor grill 5, a base frame 3, a bulk head 4, an indoor air circuit A, and an outdoor air circuit B. The indoor grill 2 is detachably attached to the bulk head 4 and the base frame 3 from the front side of the main body 1. The indoor grill 2 has an intake opening 5. The base frame 3 is formed of resin and is provided with an outer casing portion 6 with which the outdoor air circuit B is covered, and a base plate portion 7 partially inserted in the indoor grill 2. At the external sides of the outer casing 6, there are provided a louver 8 continuously extending from a left side face to a right side face via a rear face and also serving as a reinforcement for the outer casing 6, an intake louver 9 vertically extending on the top face of the main body and serving as a reinforcement for the outer casing 6 as well, a rail portion 10 to which a mount device 65 is attached on the indoor side (front side) of the intake louver 9, and a corrugated portion 11 which limits the movement of the mount device 65 in the widthwise direction of the main body 1. An intake section constituted by the louver 8 is indicated at 14 and a blowing section is indicated at 15. The louver 8 has a wedge shape increased in thickness toward the interior of the assembled unit and having a round extreme end. Inside the outer casing 6 are provided vertical ribs 16 which reinforce the louver 8 of the blowing section 15 and which project toward the indoor side, bosses 18, 19 for fixing on the base frame 3 the condenser 17 constituting a refrigerating cycle which is know per se, bosses 20 for fixing two ends of the bulk head 4 forming a partition between the indoor and outdoor sides, a boss 21 for fixing a central portion of the bulk head 4, and ribs 24 and 25 for preventing noise due to contact between end plates 22 and 23 of the condenser 17 and the outer casing 3, which ribs are arranged to contact upper and lower ends of the end plates 22 and 23. A description will now be given of the base plate portion 7 partially inserted in the indoor grill 2. On a base plate portion 7A inserted in the indoor grill 2, a rib 26 higher than the lower end of the louver 8 is formed through a whole peripheral region and is connected to the outer casing 6. Holes 34 for fixing, with screws, the evaporator 33 constituting the well-known refrigerating cycle are formed on the front side of the rib 26.

Inside the base plate portion 7 are provided a pair of bolts 29 for fixing through rubber mounts 28 the compressor 27 constituting the well-known refrigerating cycle, circular ribs 30 for supporting circumferential portions of the rubber mounts 28, a rib 31 for positioning a lower portion of the bulk head 4 on the base plate portion 7, U-like grooves 32 for fixing the bulk head 4 on the base plate portion 7 through the rib 31, and a splash guard portion 66. On the bottom surface of the base plate portion 7 are provided a rail portion 12 to which the mount device 65 is attached, and a rib (not shown) for reinforcing the base plate portion 7. The rail portion 12 is constituted by a rib 12A on the indoor side, a rib 12B on the outdoor side, and a rib 12C which limits the movement of the mount device 65 in the vertical direction (in the direction of height). A corrugated portion 13 which limits the movement of the mount device 65 in the widthwise direction of the main body 1 is provided inside of the rib 12B. The rib 12C is formed so as to have a gap C and to be thereby prevented from being brought into direct contact with the floor surface when the main body 1 is mounted or placed on the floor. The rib 12C is connected to the ribs 12A and 12B.

Figure 7:
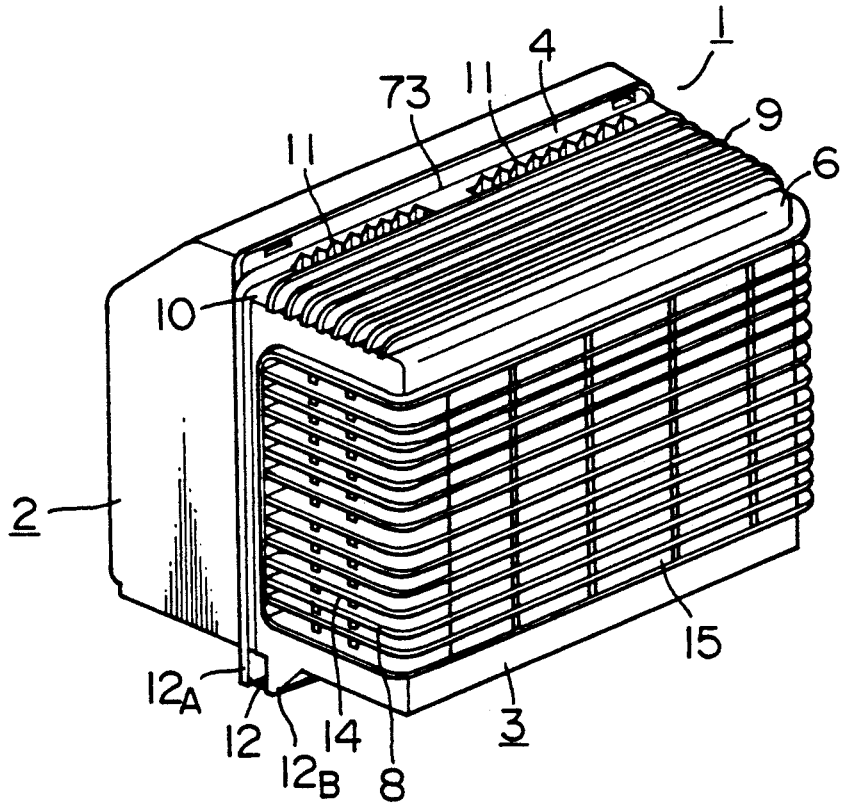
FIG. 7 is a rear perspective view of the identical integrated type air conditioner.
Figure 8:
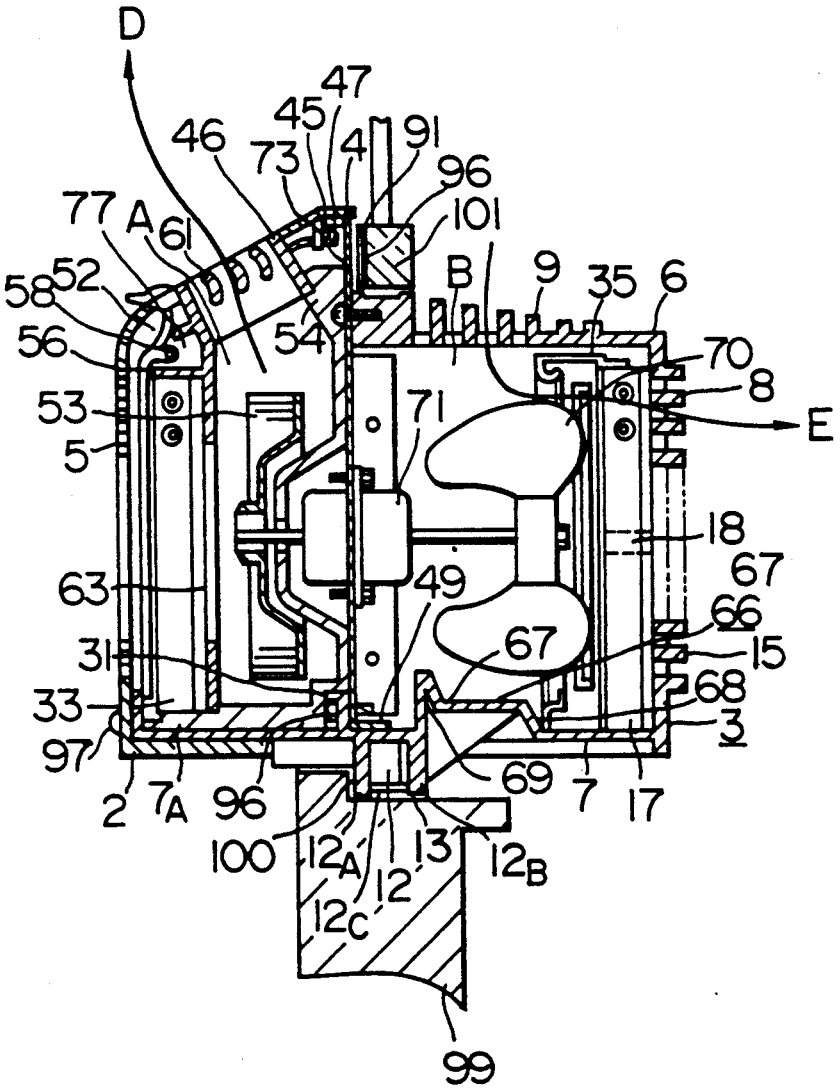
FIG. 8 is a longitudinal sectional view of this integrated type air conditioner.

The outdoor air circuit B is constituted by a propeller fan 70 which faces the blowing section 15, which supplies air to the condenser 17 to release the heat of the condenser 17 and which has a slinger ring for dispersing water on the base plate 7, a fan motor 71 fixed to the bulk head 4 with screws and serving to drive the propeller fan 70, an air guider 35, a lead wire cover 36 for covering lead wires of the fan motor 71, the compressor 27, a piping and other components. A description will be given below of the splash guard portion 66 provided inside the base plate portion 7. The splash guard portion 66 is constituted by a flat surface portion 67 projecting from the base plate portion 7 below the propeller fan 70, an inclined surface 68 (hereinafter referred to as a slant surface) for positioning the lower end of the air guider 35, and a rib 69 projecting from the flat surface portion 67 at an indoor side peripheral position on the same and on the inlet side of the propeller fan 70 with respect to the direction of rotation thereof. A description will next be given of the bulk head 4 (FIG. 7). The bulk head 4 is formed of a sheet metal, which is constituted by holes 37 for attachment of the fan motor 71, a drawn portion 38 for accommodating the compressor 27, a drawn portion 39 for accommodating the lead wires of the fan motor 71, a hole 41 for leading the lead wires of the fan motor 71 and the compressor 27 to a power supply board 40 on the indoor side, holes 42 for fixation on the base frame 3 with screws, opposite end portions 43 bent to the outdoor side, attachment holes 44 for fixing the mount device 65, a portion 45 bent to the indoor side, grooves 48 for engagement with claws 47 of a blowing grill 46, a bent portion 49 for setting on the base frame portion 7, holes and grooves (both not shown) for fixing the power supply board 4, opposite end bent portions 72 which limit the movement of the mount device 65 in the vertical direction (direction of height), a mount portion 73 which protrudes upward beyond the base frame 3 when the main body assembly is completed and which overlaps a sash at the time of installation, a section 74 for accommodating a base portion 27A of the compressor 27, and cuts 78 and a bent portion 79 for engagement with the indoor grill 2. Other drawn portions necessary for avoiding resonance with the fan motor 71 and deficiency of strength are provided.

The air guider 35 (FIG. 13) has a condenser cover 50 with which the upper end of the condenser 17 is covered for the purpose of providing an airtight property for air supply and preventing dispersion of water droplets, an orifice 51 elongated in the vertical direction, bent semicircularly from the bulk head 4 toward the condenser 17, partially bent upward only at a lower position, having a center higher than the center of the propeller fan 70, and holes 75 and 76 for fixation on the base frame 3 through the bosses 18 and 19 along with the condenser 17.

The indoor air circuit A is constituted by the evaporator 33 disposed so as to face the indoor grill 2 and the intake opening 5 of the indoor grill 2 and to have its lower end engaged with the base plate portion 7, an air filter 52 between the evaporator 33 and the intake opening 5, a scirocco air guider 54 formed of a heating insulating cellular material, serving to supply condensate produced by the evaporator 33 to the outdoor air circuit B and also serving as an air guider for a scirocco fan 53 attached to the fan motor 71 to supply air to the evaporator 33, the blowing grill 46, an operation panel 55, an air intake opening 63 for the scirocco fan 53, a top surface cover 56 for the evaporator 33, engagement pieces 57 for fixing upper ends of end plates of the evaporator 33, grooves 59 for fixing a thermocapillary 58, cuts 60 for supplying air in the vicinity of the thermocapillary 58 to the scirocco fan 53, the claws 47 which engage with the bulk head 4, the blowing grill 46 which also serves as an indoor rail 77 for guiding the air filter 52, change blades 61 for changing the air blown through the blowing grill 46, the power supply board 40 in which electrical parts are mounted, a sound insulation plate 62 with which the compressor 27 protruding on the indoor side beyond the bulk head is covered, a piping and other components.

A description will now be given of the indoor grill 2. The indoor grill 2 (FIG. 14) is provided with the intake opening 5 on the front side, left and right claws 80 which are formed at its upper end to engage with the cuts 78 of the bulk head 4, claws 81 which engage with the bent portion 79 of the bulk head 4, an opening 82 in which the blowing grill 46 is inserted, and holes 83 for fixation on the base plate portion 7 of the base frame 3 with screws. The upper end of the intake opening 5 is positioned (in the direction of height) so as to be located higher than the evaporator 33 and generally in front of the thermocapillary 58.

Figure 17A:
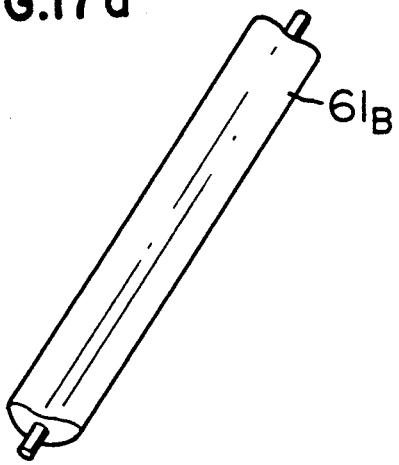
FIGS. 17(*a*) and 17(*b*) are perspective views of air flow direction changing blades of the identical integrated type air conditioner.
Figure 17B:
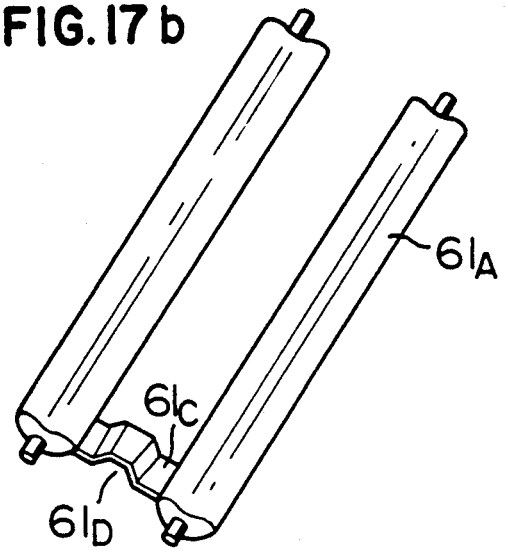
Figure 18:
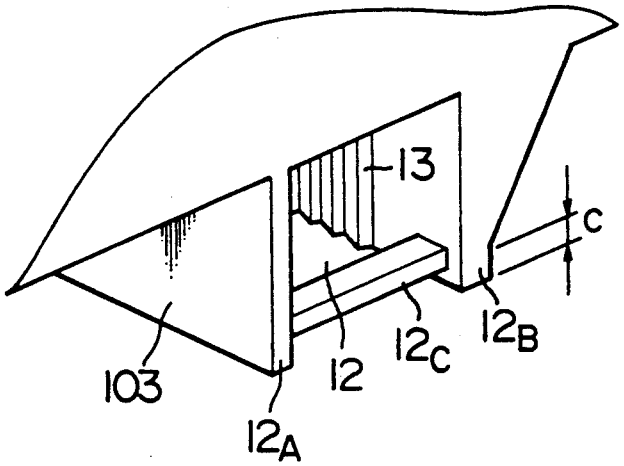
FIG. 18 is a perspective view of an essential portion (portion F) of a base frame of the identical integrated type air conditioner.
Figure 19:
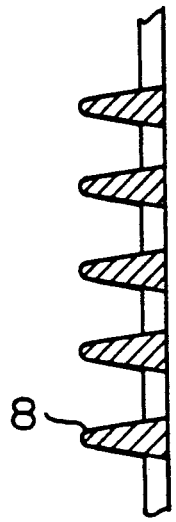
FIG. 19 is a cross-sectional view of a base frame louver of the identical integrated type air conditioner.
Figure 20:
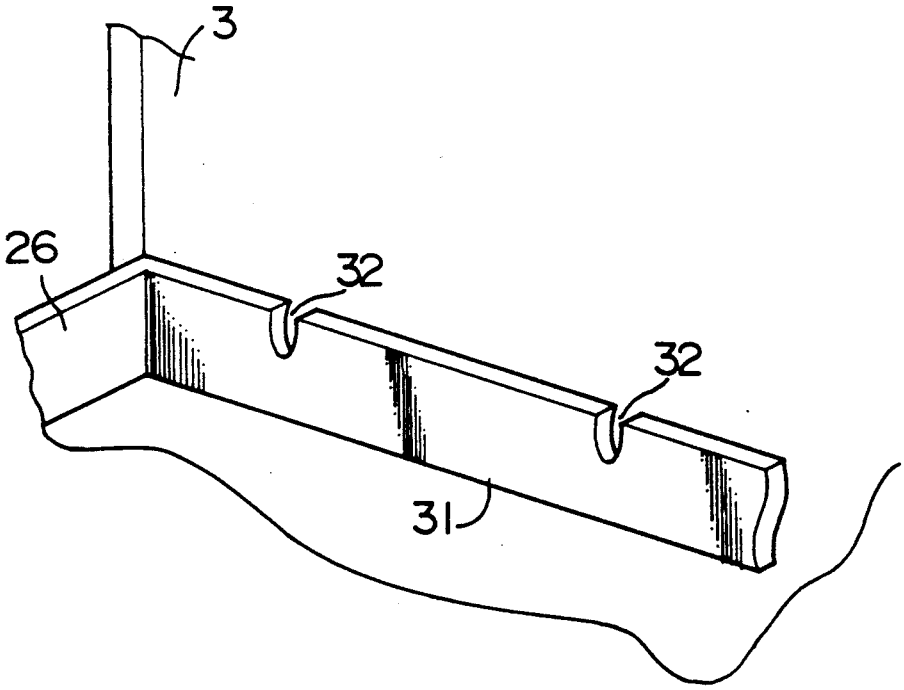
FIG. 20 is a perspective view of a rib of an essential portion of the base frame of the identical integrated type air conditioner.

Then a description will be given of the change blades 61 (FIG. 17). The change blades 61 are rotatably (changeably) attached to the blowing grill 46. Each plate 61 is composed of a pair of blades 61A and a blade 61B. The pair of blades 61A are integrally formed while being connected by a PP resin connection member 61A having a hinge effect so as to be rotatable (changeable) on the connection portion 61A. The change blade 61B is hung on a groove 61D of the connection member 61C so as to be rotatable together with the change blades 61A.

Figure 21A:
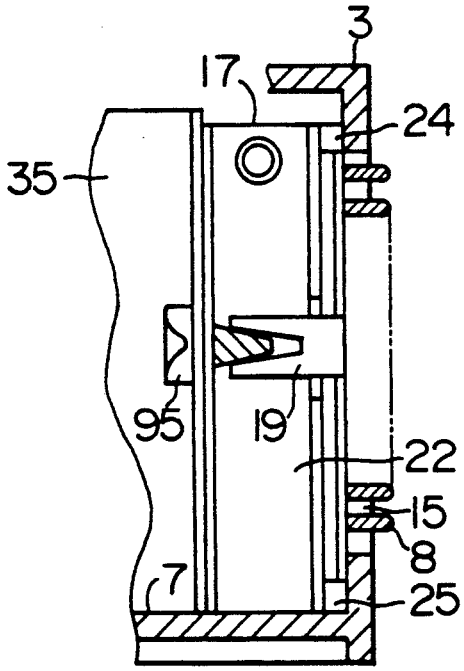
FIGS. 21(*a*) and 21(*b*) are a cross-sectional views of assembly of essential portions of the identical integrated type air conditioner.
Figure 21B:
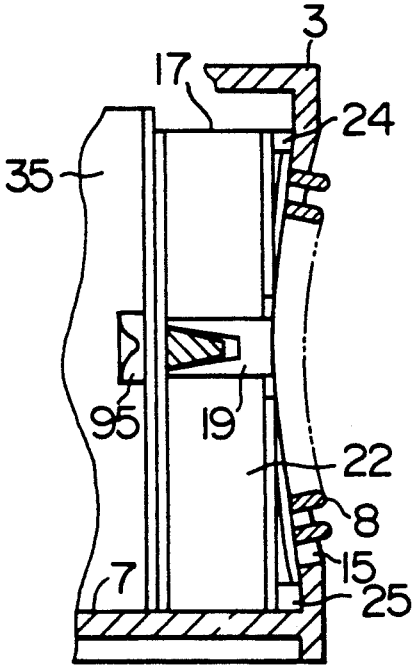
Figure 22A:
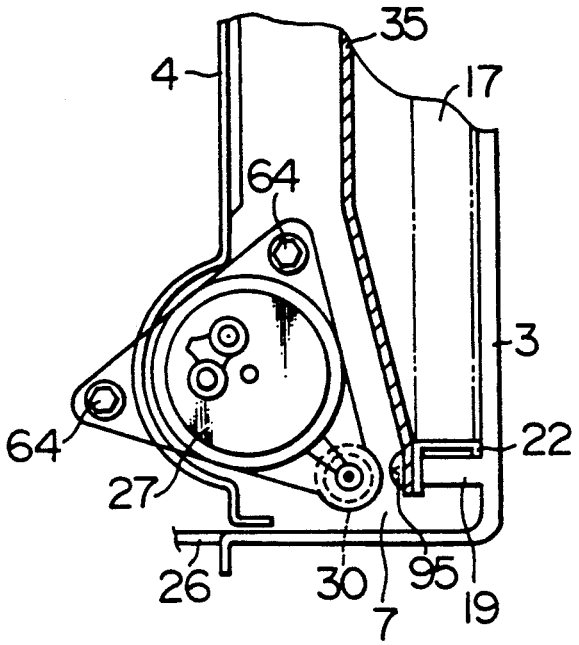
FIGS. 22(*a*) through 22(*c*) are diagrams of attachment of a compressor of the identical integrated type air conditioner.
Figure 22B:
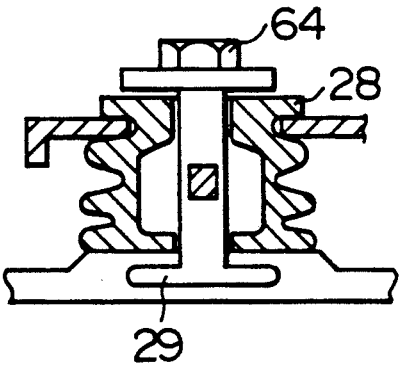
Figure 22C:
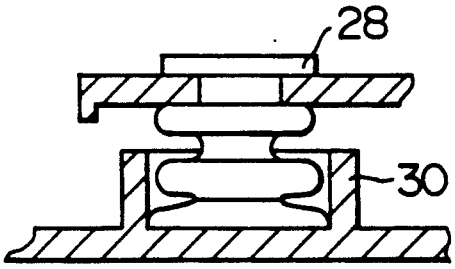
Figure 23:
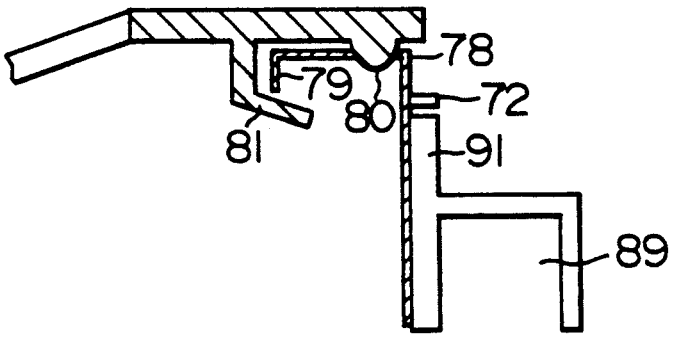
FIG. 23 is a cross-sectional view of attachment of the indoor grill of the identical integrated type air conditioner.

Next, a description will be given of the mount device 65. The mount device 65 (FIG. 15) is constituted by a mount frame 84 and bellows 85 expandable in the widthwise direction of the main body 1. A catch portion 86 of the bellows 85 engages with projections 87 of the mount frame 84. The mount frame (FIGS. 15 and 16) is composed of a sash receiving portion 88 on which the sash is placed, a U-like portion 89 inserted into the above-mentioned rail portion 10 of the base frame 3, another U-like portion 90 inserted into the above-mentioned rail portion 12 of the base plate portion 7, and a rib 91 inserted below the bent portion 72 of the bulk head 4. The U-like portions 89 and 90 are provided with projection portions 93 and 94 which make contact with the corrugated portions 11 and 13 of the base frame 3 to limit the movement of the mount device 65 in the widthwise direction. The assembly process will now be described below. First, the condenser 17 to which a piping (not shown) is attached is inserted into the base frame 3 from the indoor side. Then the lower end of the air guider 35 is obliquely inserted along the slant surface 67 over the splash guard portion 66, and the condenser 17 and the air guider 35 are fastened together to the base frame 3 with screws 95. At this time, the relationship between the sizes of the bosses 18 and 19, the condenser 17 and the ribs 24 and 25 is such that the base frame 3 is deformed as shown in FIG. 21.

Next, the intake pipe and the rubber mounts 28 are attached to the compressor 28, and the compressor 28 is inserted from the indoor side to be mounted as shown in FIG. 25, and is fixed on the base plate portion 7 with two bolts 64 through the rubber mounts 28. Then brazing of the piping (not shown) and wiring of the compressor 27 are performed. Next, the fan motor 71 is attached to the bulk head 4 with screws, the lead wire cover 36 is fixed over the lead wires of the fan motor 71, the lead wires are led along the drawn portion 39 and further led to the indoor side through the hole 41, the propeller fan 70 is attached to the fan motor 71, and the propeller fan 70 and the fan motor 71 are set from the indoor side by being moved over the rib 31 and are fixed on the outer casing 6 and the base plate portion 7 with screws 96. At this time, the wiring of the compressor 27 is led to the indoor side through the hole 41. Then the sound insulating plate 62 is attached to the bulk head 4, the scirocco air guider 54 is set on the base plate portion 7 from the indoor side, and the scirocco fan 53 is attached to the fan motor 71.

Next, the evaporator 53 is fixed to the rib 27 of the base plate portion 7, the blowing grill 46 is inserted, and the claws 57 are brought into engagement with the two end plates of the evaporator 33, while the claws 47 are brought into engagement with cuts 48 of the bulk head 4 The power supply board 40 is then fixed on the bulk head 4, and the thermocapillary 58 is led over the evaporator 33 along the grooves 47. Thereafter the front grill 46 is fitted thereonto from the front side. The blowing grill 46 is inserted into the opening 82 of the front grill 2, is brought into engagement with the bulk head 4 by means of the claws 80 and 81 and is fixed on the base plate portion 7 with screws 97, and the air filter 52 is inserted, thereby the front grill 2 covers the bulk head 4 and the base frame 3. A groove 98 is defined around (on the periphery of) the blowing grill 46 by the blowing grill 46 and the indoor grill 22.

A description will next be given of installation. First, the mount base 65 is inserted into the rail portions 10 and 12 of the base frame 3, and the bellows 85 is fixed by screwing into the holes 44 of the bulk head 4. Since at this time the projections 93 and 94 of the mount frame 84 are brought into contact with the corrugated portions 11 and 13, the mount device 64 can be fixed at a position freely selected. The main body 1 is thereafter mounted. First, the main body 1 is placed on a window frame base 99 so that the rib 12A of the base frame 3 extends along a vertical surface 100 of the window frame base 99. Thereafter a sash 101 is moved downward onto the sash receiving portion 88 of the mount device 65 along the rib 91 of the mount device 65. The main body 1 is thereby placed in the window.

Figure 9:
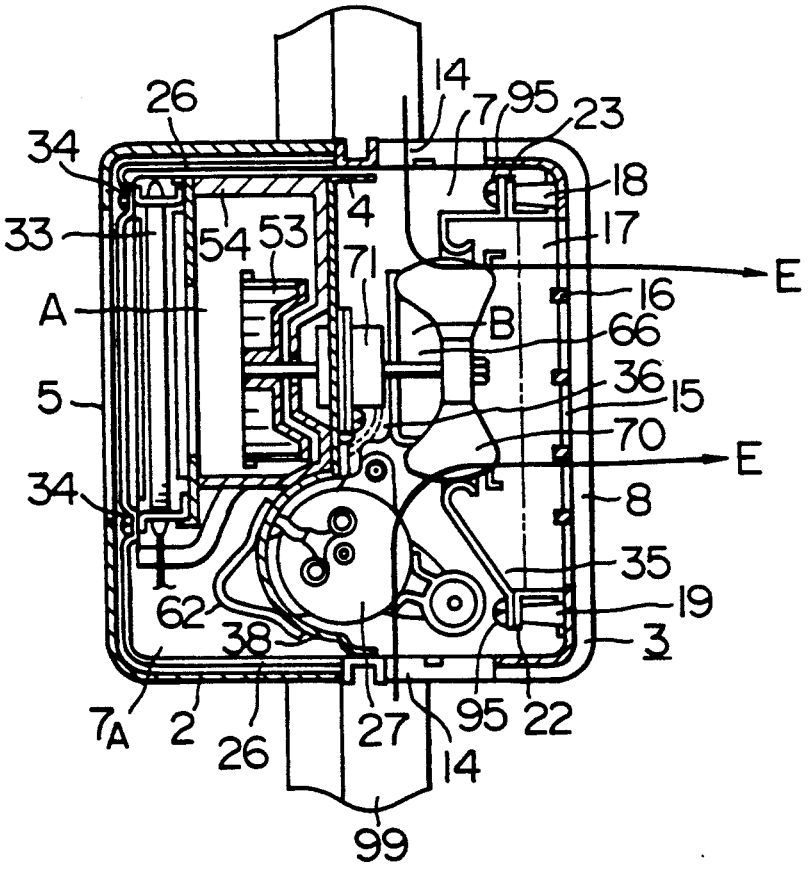
FIG. 9 is a transverse sectional view of the identical integrated type air conditioner.
Figure 10:
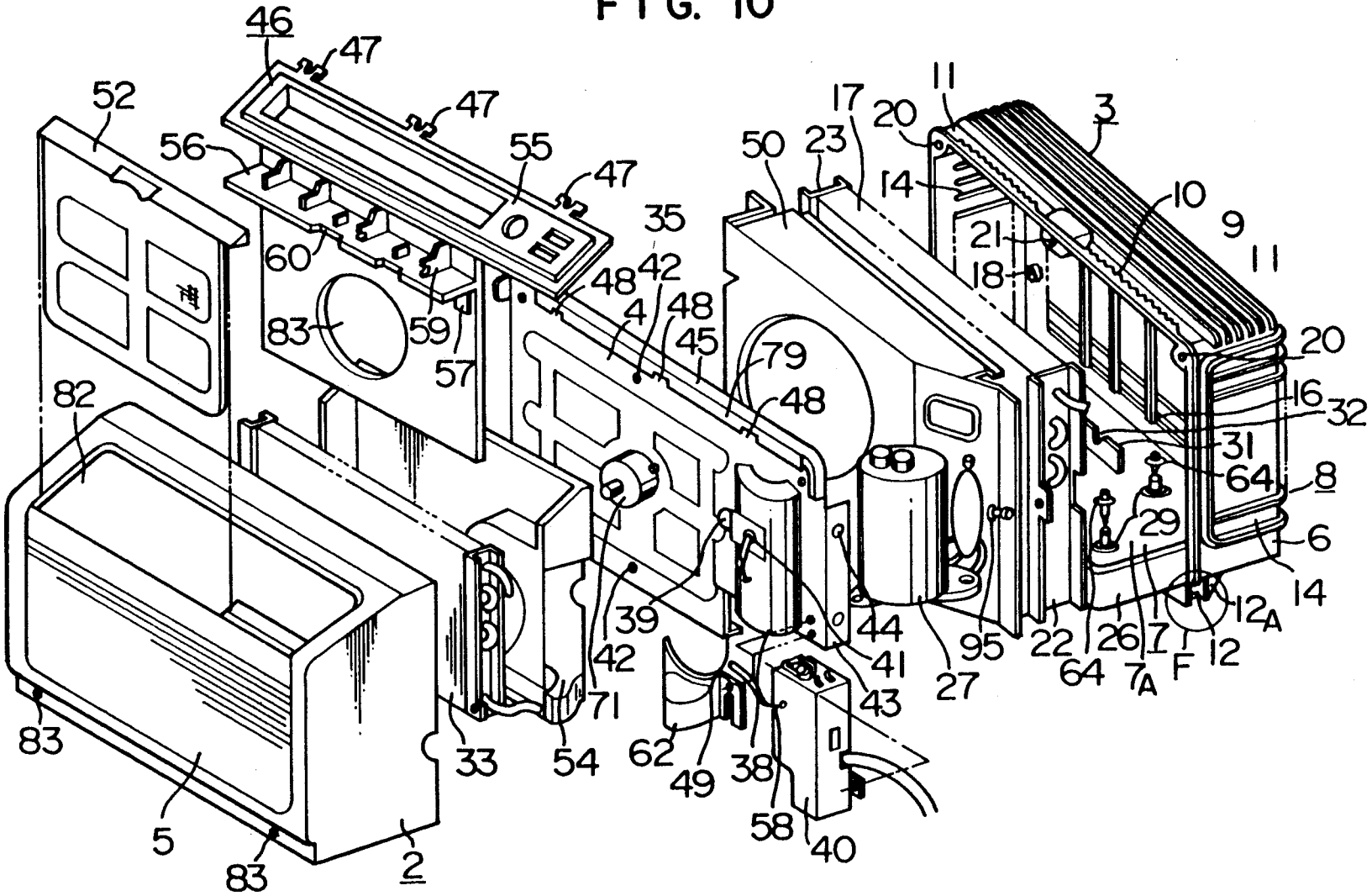
FIG. 10 is an exploded perspective view of the identical integrated type air conditioner.
Figure 11:
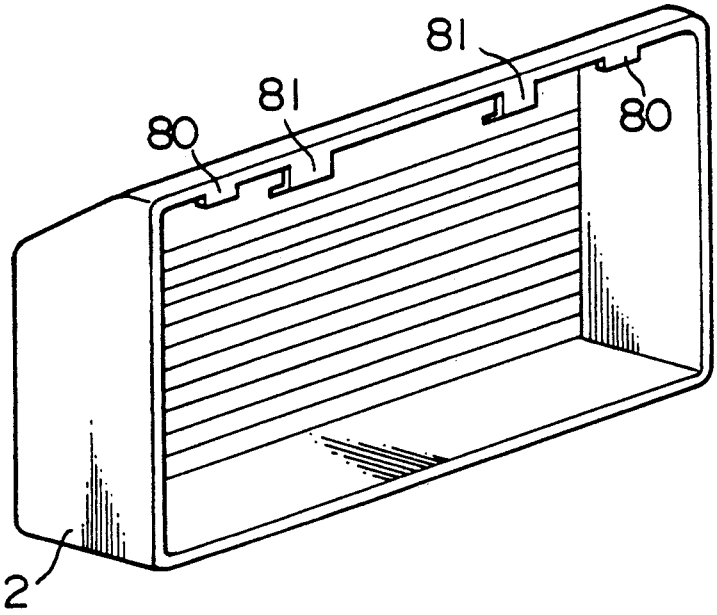
FIG. 11 is a perspective view of an indoor grill of the identical integrated type air conditioner.
Figure 12:
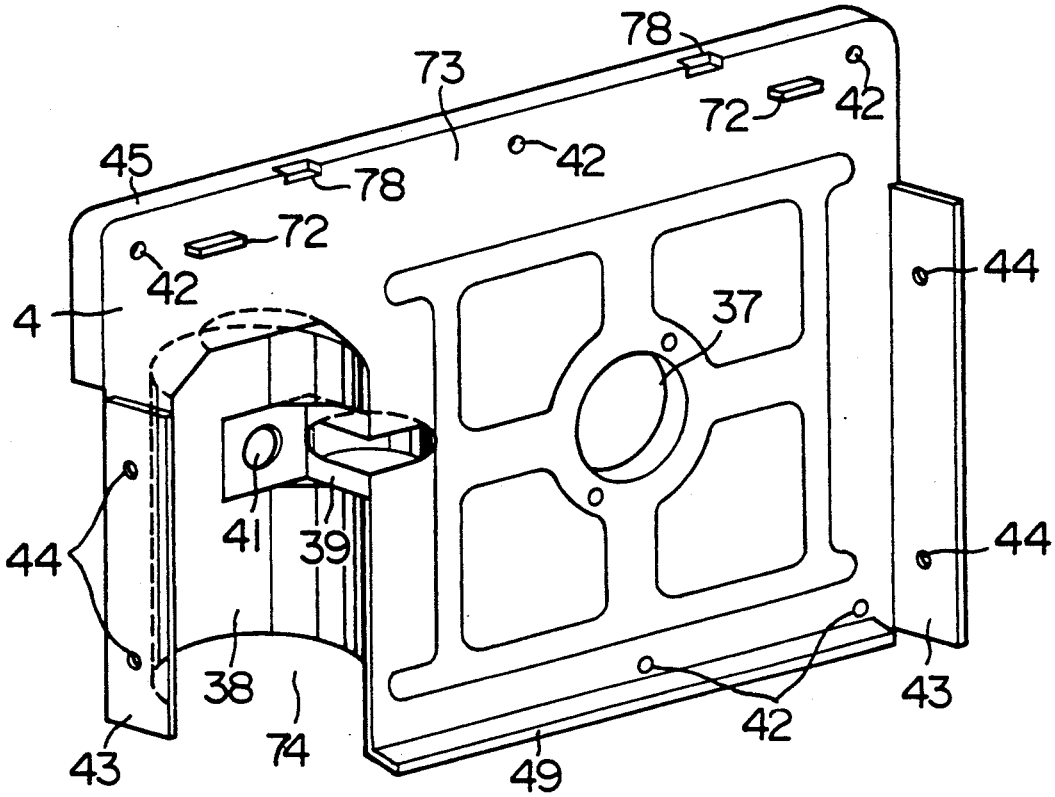
FIG. 12 is a perspective view of a bulk head of the identical integrated type air conditioner.
Figure 13:
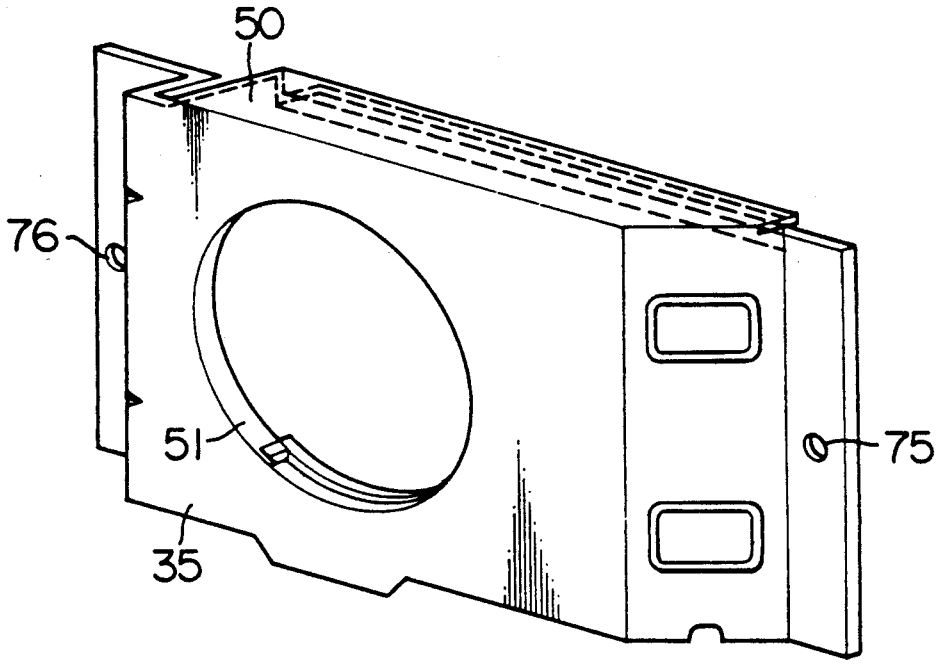
FIG. 13 is a perspective view of an air guider of the identical integrated type air conditioner.
Figure 14:
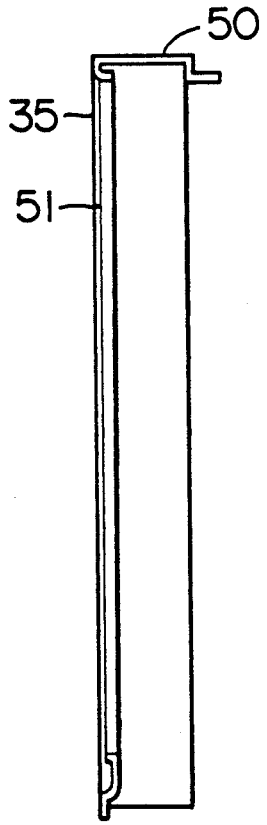
FIG. 14 is a perspective view of the air guider of the identical integrated type air conditioner.
Figure 15:
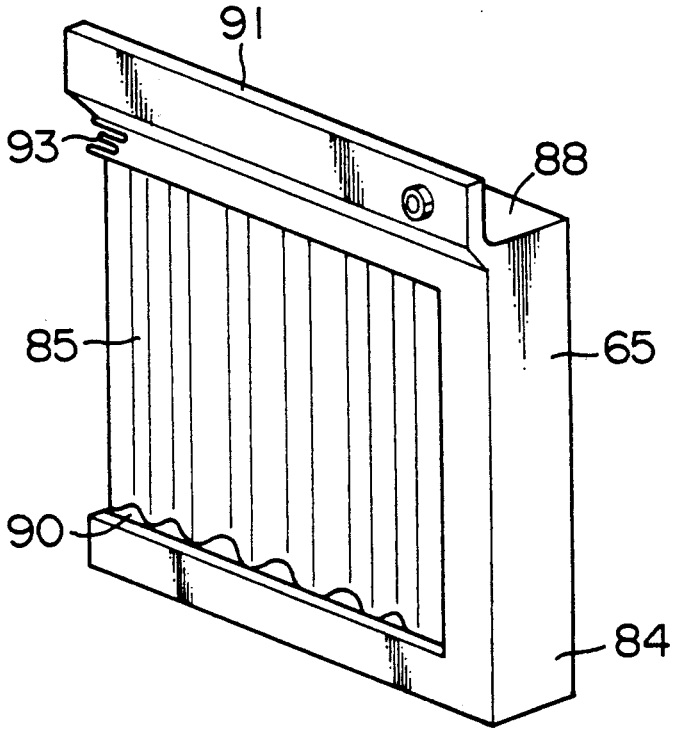
FIG. 15 is a perspective view of a mount device of the identical integrated type air conditioner.
Figure 16:
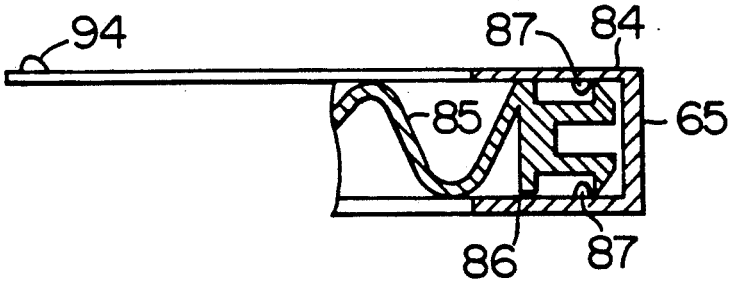
FIG. 16 is a half sectional view of the mount device of the identical integrated type air conditioner.

Next, the mount device 65 is shifted in the widthwise direction of the main body 1 for adjustment in accordance with the horizontal width of the window, and the mount device 65 is fixed to the sash 101 with screws, thereby completing the installation. At this time, the relationship between the rib 91 of the mount device 65 and the rib 12A of the base frame 3 in the direction of the depth is such that a surface 102 of the rib 81 on the outdoor side is flush with a surface 103 of the rib 12A on the outdoor side or that the surface 103 of the rib 12A on the indoor side is off to the outdoor side. Because the installed state is as shown in FIG. 9, the compressor 27 is in a state of being supported on the window frame base 99.

Flows of air and water will be described below. With respect to a flow of air on the indoor side, indoor air is drawn in through the intake opening 5 of the front grill 2 as indicated by the arrow D by the scirocco fan 53, supplied through the air filter 52 and the intake opening 63, cooled by the evaporator 33, and blown out to the indoor side via the scirocco air guider 54 and the blowing grill 46. With respect to a flow of air on the outdoor side, outdoor air is drawn in through the intake louver 9 of the base frame 3 and the intake section 14 as indicated by the arrow E by the propeller fan 70, supplied through the air guider 35, heated up by the condenser 17 and blown out to the outside of the room. The formation of such an air circuit (air flow) on the outdoor side enables the air heated up by the condenser 17 to be immediately blown out to the outside of the room, so that a material having a low heat resisting temperature can be used for the base frame 3, and that the heat leakage to the indoor side can be reduced.

With respect to a flow of water, the condensate condensed by the condenser 33 is led to the outdoor side by the scirocco air guide 54, is collected on the base plate portion 7 of the base frame 3 and is sprinkled on the condenser 17 by the slinger ring provided on the propeller fan 70. At this time, the splash guard portion 66 prevents the condensate ruffled by the pressure of air from the propeller fan 70 from being splashed by the propeller fan 70. In the above-described arrangement, the fundamental structural parts are the indoor grill 2, the base frame 3, which are formed of resin, and the bulk head 4 formed of a sheet metal. Therefore the number of parts is reduced and the dimensional accuracy of the assembly can be improved. Because the base plate portion 7 of the base frame 3 is inserted into the indoor grill 2, the condensate can be positively led to the outdoor side, and there is no need for a heat insulating material and the like for processing the condensate. It is possible to improve the dimensional attachment precision, because the condenser 17 is fixed directly to the base frame 3. The number of parts of the mount device is small and the main body 1 can be installed, because a part of the bulk head 4 is used as a mount device.

Figure 24:
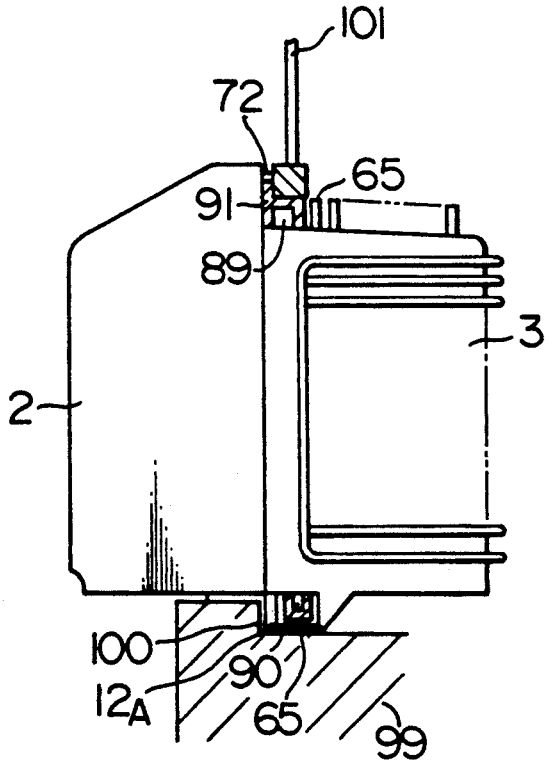
FIG. 24 is a half sectional view showing the mounted state of the indoor grill of the identical integrated type air conditioner.

The main body 1 also can easily be installed in the desired condition, because the rib 91 of the mount device 65 and the rib 12A of the base frame 3 are maintained in the positional relationship as shown in FIG. 24. Moreover, it is possible to automate the assembly because the component parts and screws of the main body are attached from the indoor side.

INDUSTRIAL APPLICABILITY

In the structure of the present invention, as described above in detail, fundamental component parts including a base plate and an outer casing are integrally formed as resin moldings on the indoor side and the outdoor side, and a bulk head formed of a sheet metal is provided at the boundary between the indoor side and the outdoor side, so that the number of fundamental parts is small and that an improvement in quality can be achieved.

Further, the base plate and the outer casing are integrally formed as resin moldings on the indoor side and the outdoor side, a portion of the integrally formed molding on the outdoor side is extended to the indoor side, and a bulk head formed of a sheet metal is provided at the boundary between the indoor side and the outdoor side, thereby enabling the condensate to be positively led to the outdoor side and eliminating the need for a heat insulating material and the like for processing the condensate.

Further, the base plate and the outer casing are integrally formed as resin moldings on the indoor side and the outdoor side, screw bosses are provided on the rear side of the integrally formed molding on the outdoor side generally at the center thereof and at the positions where the two side end plates of the condenser are located, and screw attachment holes are formed in the two side end plates of the condenser, thereby fixing the condenser directly to the integrally formed part on the outdoor side (base frame). The number of parts can thereby be reduced and improvements in attachment dimensional accuracy and quality can be achieved.

Further the base plate and the outer casing are integrally formed as resin moldings on the indoor side and the outdoor side, a bulk head formed of a sheet metal and having and upper end protruding beyond the integrally formed molding on the outdoor side is provided at the boundary between the indoor side and the outdoor side to be used as a mount device, thereby enabling a reduction in the number of parts and secure installation.

Further, according to the present invention, the base plate and the outer casing are integrally formed as resin moldings on the indoor side and the outdoor side, ribs which define grooves into which a mount device is inserted are provided on the top and bottom surfaces of the integrally formed molding on the outdoor side, and these ribs are brought into contact with window members at the time of installation, thereby enabling the main body to be installed in the desired condition.

Further, according to the present invention, all the parts and screws can be attached and fastened from the indoor side, so that assembly automation, labor saving and an improvement in quality can be achieved.

What is claimed is:

1. An integrated type air conditioner having an indoor side and an outdoor side and including a compressor, a condenser, an evaporator and other components, said air conditioner further comprising an outdoor side resin molding in which an outdoor base plate and an outer casing are integrally incorporated with one another and which has an opening part on an indoor side thereof; an indoor side resin molding in which an indoor base plate and an outer casing are integrally incorporated with each other and which has an opening part on the outdoor side; and a partition plate formed of sheet metal and fixed to said opening part of the outdoor side molding and the opening part of the indoor side molding at a plurality of positions therearound, whereby said outdoor side molding and said indoor side molding are completely supported by said partition plate.

2. An integrated type air conditioner according to claim 1, wherein the outdoor side base plate extends into the indoor side.

3. An integrated type air conditioner according to claim 1, wherein said condenser has two side plates which are attached at heightwise centers thereof to said outdoor said resin molding directly by means of screws.

4. An integrated type air conditioner according to claim 1, wherein said partition plate defines a boundary between the indoor side and the outdoor side and is projected upwardly from the outdoor side resin molding.

5. An integrated type air conditioner according to claim 1, wherein said outdoor side resin molding has top and bottom surface parts formed therein with grooves through which a mount means is inserted to mount the air conditioner to a window frame and also include ribs found thereon which are adapted to make contact with the window frame.

6. An integrated type air conditioner according to claim 2, wherein said indoor side resin molding includes an indoor side grille, and components other than those belonging to said indoor side grille are attached to said outdoor base plate.

7. An integrated type air conditioner according to claim 6, wherein each of said components attached to said outdoor base plate, except those attached to a part thereof which extends into said indoor side, is formed therein with attaching screw holes which are directed toward said indoor side.

* * * * *